US005437746A

United States Patent [19]

Usui et al.

[11] Patent Number: 5,437,746

[45] Date of Patent: Aug. 1, 1995

[54] ALUMINUM ALLOY SHEET FOR DISCS HAVING GOOD PLATABILITY

[75] Inventors: Eiki Usui; Masahiro Kawaguchi, both of Tochigi, Japan

[73] Assignee: Kabushiki Kaisha Kobe Seiko Sho, Kobe, Japan

[21] Appl. No.: 186,098

[22] Filed: Jan. 25, 1994

Related U.S. Application Data

[63] Continuation of Ser. No. 511,944, Apr. 16, 1990, abandoned, which is a continuation of Ser. No. 699,124, Feb. 7, 1985, abandoned.

[30] Foreign Application Priority Data

Feb. 18, 1984 [JP] Japan ..... 59-29402

[51] Int. Cl.[6] ..... C22C 21/06

[52] U.S. Cl. ..... 148/439; 148/523; 148/551; 148/552; 148/691; 148/692; 148/695; 148/415; 148/417; 148/418; 148/440; 420/532; 420/533; 420/541; 420/547; 420/550; 428/650; 428/652; 428/687; 428/928

[58] Field of Search ..... 420/532, 533, 541, 547, 420/550; 148/523, 551, 552, 695, 691, 692, 415, 417, 418, 439, 440; 428/650, 652, 687, 928

[56] References Cited

U.S. PATENT DOCUMENTS

| | | | |
|---|---|---|---|
| 3,359,085 | 12/1967 | Anderson | 148/11.5 A |
| 3,496,620 | 2/1970 | Wolfe | 428/654 |
| 4,169,728 | 2/1979 | Takeuchi et al. | 420/532 |
| 4,431,461 | 2/1984 | Hoshino et al. | 148/523 |
| 4,753,685 | 6/1988 | Usui et al. | 148/439 |

FOREIGN PATENT DOCUMENTS

| | | |
|---|---|---|
| 2013579 | 10/1971 | Germany . |
| 59-193537 | 2/1984 | Japan . |

OTHER PUBLICATIONS

"Aluminium-Taschenbuch", pp. 25, 255, 1015, 1016 and 1021; Aluminium-Verlag Düsseldorf, 1983.

*Primary Examiner*—David A. Simmons
*Assistant Examiner*—Robert R. Koehler
*Attorney, Agent, or Firm*—Oblon, Spivak, McClelland, Maier & Neustadt

[57] ABSTRACT

An aluminium alloy sheet for various discs having good platability is described. The alloy consists essentially of 2 to 6 wt % of Mg, 0.1 to 0.5 wt % of Zn, 0.03 to 0.40 wt % of Cu, 0.01 to 0.30 wt % of Fe and the balance of Al.

6 Claims, 2 Drawing Sheets

ALLOY A (INVENTIVE)

ALLOY H (COMPARATIVE)

ALLOY B (COMPARATIVE)

ALLOY A (INVENTIVE)

ALLOY H (COMPARATIVE)

ALLOY B (COMPARATIVE)

ALLOY A (INVENTIVE)

ALUMINUM ALLOY SHEET FOR DISCS HAVING GOOD PLATABILITY

This application is a Continuation of application Ser. No. 07/511,944, filed on Apr. 16, 1990, which is a continuation of Ser. No. 06/699,124, filed Feb. 7, 1985, both now abandoned.

BACKGROUND OF THE INVENTION

1. Field of the Invention

This invention relates to alloys and more particularly, to aluminium alloy sheets for discs having good platability.

2. Description of the Prior Art

As is known in the art, substrates for discs such as magnetic discs, optical discs and optical-magnetic discs and the like should be non-magnetic and have high rigidity sufficient to withstand the rotation of high speed and good resistance to corrosion. In view of the above, it is conventional to use aluminium alloys as the substrate. As described above, several types of discs are known and substrates for magnetic discs will be described herein only for convenience's sake.

Because the distance between a substrate for magnetic disc and a magnetic head is so small as less than about 1 μm and the disc is rotated at high speed relative to the head, the smoothness of the substrate for the disc is also one of important characteristics.

In recent years, the magnetic recording density is so increased that the distance between the disc substrate and the magnetic head becomes much smaller with an attendant smaller unit recording area (i.e. bit size). This in turn requires that the substrate surface have a roughness as small as possible. In addition, it is also required that the defects on the substrate surface be as small as possible not only in size, but also in number.

In order to make a smooth substrate for a magnetic disc, there has been proposed a method in which an aluminium alloy substrate is subjected to anodization or plating to form a hard film on the substrate and is then polished.

Typical aluminium alloys for magnetic discs which have been used for plating are A,A5086 alloys. JIS 7075 alloys are sometimes used for these purposes.

However, these known alloy materials have the drawback that they tend to be roughened on the surface thereof due to the fact that the crystallization phase (Al—Fe, Al—Mn—Fe and the like) or the precipitation phase (Al—Cu—Mg in the JIS 7075 alloys) of an aluminium alloy sheet comes off at the time of polishing or comes of by dissolution at the time of pretreatments for plating.

Fabrication of discs from JIS 7075 alloy, which are heat treatable alloy, by punching or cutting from a rolled sheet of the alloy involves the drawback that where the disc is annealed to remove the strain therefrom, the cooling speed must be properly controlled to suppress the internal stress.

As described above, for the reasons that the aluminium alloy disc tends to be roughened on the surface thereof, and pits (small holes) are liable to be produced on the plating layer owing to the roughening, it is the usual practice for the known materials that the plating film is formed in a relatively large thickness of about 30 to 50 μm and is subsequently polished.

However, in order to improve the productivity and reduce the cost, it is important to make the plating layer with a small thickness. Aside from the thickness of the plating film, it is also important to reduce a number of pits and to reduce the roughness in the pretreatment. To this end, attempts were made to use 99.9 wt % or 99.99 wt % Al metal for producing fine intermetalic compounds. However, the mere increase of the purity in the metal results not only in an increasing roughness on the surface being plated, but also in a lowering of the plate adhesion.

SUMMARY OF THE INVENTION

It is an object of the invention to provide aluminium alloy sheets for various discs which overcome the prior art drawbacks or problems.

It is another object of the invention to provide aluminium alloy sheets for discs which have good platability.

The above objects can be achieved, according to the present invention, by an aluminium alloy sheet for discs which consists essentially of 2 to 6 wt % of Mg, 0.1 to 0.5 wt % of Zn, 0.03 to 0.40 wt % of Cu, 0.01 to 0.30 wt % of Fe, and the balance of Al.

DETAILED DESCRIPTION AND EMBODIMENTS OF THE INVENTION

Figure 1C:
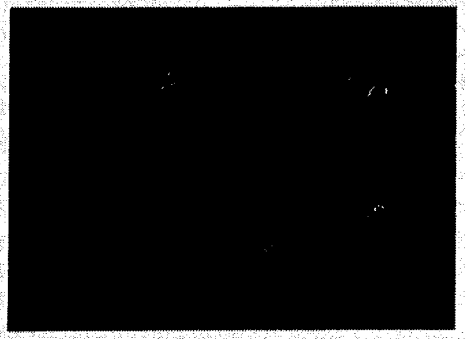
FIGS. 1 (*a*), 1(*b*) and 1(*c*) are microphotographs showing an aluminium alloy sheet for magnetic disc having good platability and comparative sheets treated by zinc substitution.

The components of an aluminium alloy sheet for discs having good platability according to the invention and ratios thereof are described below.

Mg is an element which is necessary for imparting strength sufficient for a disc substrate. If the content is below 2 wt %, the strength necessary for a disc substrate cannot be obtained. On the contrary, when the content is over 6 wt %, the resulting alloy is apt to break at the edges thereof upon rolling, with a lowering of productivity. Accordingly, the content of Mg is in the range of from 2 to 6 wt %.

Zn and Cu are uniformly dissolved in the aluminium alloy and are elements which serve to make the roughness of a plating film small and uniform at the time of pretreatment for plating and plating treatment.

These effects cannot be produced when the content of Zn is below 0.1 wt % and the content of Cu is below 0.03 wt %. On the other hand, even when the content of Zn exceeds 1.5 wt %, the effects are not improved to a further extent, so that not only such content is poor in economy, but also there is produced the adverse influence that the roughness becomes great in the pretreatment owing to the occurrence of stress or formation of a coarse precipitation by aging depending on the manner of heat treatment. So the preferable content of Zn is 0.1 to 0.5 wt %. If the Cu content exceeds 0.40 wt %, an Al—Mg—Cu precipitation is formed in large amounts at grain boundaries, so that the roughness becomes great and non-uniform by the pretreatment. Preferably, the content of Cu should be below 0.30 wt %. Accordingly, the content of Zn is in the range of 0.1 to 0.5 wt % and the content of Cu is in the range of 0.03 to 0.40 wt %, preferably 0.03 to 0.30 wt %. Zn and Cu must coexist for plating of a thin film. In order to improve the pretreatments for the plating, Zn or Cu may be contained singly if Fe is contained in an amount not smaller than 0.1 wt %.

Fe serves to produce an intermetallic compound of Al—Fe (if Si and/or Mn is contained as an impurity, Al—Fe—Si or Al—Fe—Mn compound is produced) and also serves as nuclei for the formation of a film in the pretreatment and plating treatment. Accordingly, uniform dispersion of Fe is effective in improving uniformity of the film. This effect is not produced when the content of Fe is less than 0.01 wt %, whereas when the content exceeds 0.30 wt %, the intermetallic compound grows, with the possibility of falling-off at the time of cutting or polishing or pretreatment for plating. In other words, the roughness becomes great and is not uniform. Accordingly, the content of Fe is in the range of 0.01 to 0.30 wt %. It will be noted that Fe gives an influence on the formation of the intermetallic compound and it is important how the intermetallic compound is distributed. The state of the distribution is influenced by the manner of casting (particularly, cooling speed) and the degree of rolling, and the former gives a greater influence.

From the above viewpoint, in order to prevent the roughness or defects on the metallic film from increasing due to the falling-off of the crystallized product, the content of Fe is conveniently in the range of 0.01 to 0.15 wt %, preferably from 0.02 to 0.10 wt %, when a so-called semi-continuous casting method is used. Alternatively, in case of a quenched, solidified structure produced by a so-called thin sheet continuous casting method (e.g. 5–40 mm in casting thickness), the content of Fe is in the range of 0.10 to 0.30 wt%.

Aside from the above-described components, impurities such as Si, Mn, Ti, B and the like may be contained within ranges allowed for the JIS 5086 alloy. Within such ranges, little influences of these impurities are given on the aluminium alloy sheet of the present invention.

Manufacture of the aluminium alloy sheet of the invention which comprises the components in the ranges defined before is described.

An aluminium alloy ingot or a continuously cast thin sheet coil is homogenized and rolled as usual. The homogenization treatment is usually effected by keeping at temperatures over 400° C. within 48 hours. Subsequently, the rolling is carried out as follows: with a large-size ingot, hot and cold rollings are effected from the standpoint of productivity and with a continuously cast thin sheet coil, cold rolling alone may be carried out, or may be hot rolled after the casting if the sheet is relatively thick. In the cold rolling step, the sheet is conveniently annealed, if necessary. With the continuously cast thin sheet coil, the annealing is performed prior to or on the way of the rolling, by which it becomes possible to prevent occurrence of segregation and improve the rolling performance. The rolled sheet is then punched or cut into a desired shape and, if necessary, annealed to remove strain, whereupon a greater strain-reducing effect is obtained when a weight or load is placed on the disc. or load is placed on the disk.

Ordinary rolled sheets have a degree of roughness, Ra=0.1–0.5 μm, which is too large for use as a disc substrate. In addition, it is necessary to further lower the strain of the sheet. To this end, the disc surface is cut or polished. However, with a surface removal to a depth below 10 μm, the strain cannot be satisfactorily removed. With the surface removal over 500 μm, the disc performance is satisfied, but such removal is not beneficial from the standpoint of productivity and economy. For the disc substrate of an aluminium alloy sheet, the removal of the surface is favorably in the range of from 10 to 500 μm in thickness. In this working step, the disc is annealed, if necessary, to remove working strain.

Subsequently, pretreatments such as degreasing, etching, immersion plating with Zu or Su are repeated, after which a non-magnetic metallic film such as Ni—P is plated on the disc. Prior to the plating of the non-magnetic metallic film such as Ni—P, strike plating such as of Cu may be affected.

If the thickness of plated film is less than 3 μm, the roughness on the disc surface becomes great by the influence of the pretreatments with the tendency of leaving pits. In addition, the depth of finishing and polishing is inevitably reduced, so that a smooth, uniform plated metallic film cannot be obtained. Thus, the thickness of the plated film should favorably be over 3 μm. In view of the strength of the film, the thickness should preferably be not less than 5 μm. Although the plated metallic film with an increasing thickness does not lower in performance, too large a thickness is not advantageous in view of economy. In this sense, the thickness over 30 to 50 μm is unfavorable.

The thus prepared, plated disc is polished and then plated or sputtered to form a magnetic film thereon to give a magnetic disc.

Aluminium alloy sheets for discs having good platability according to the invention are described in more detail by way of examples.

EXAMPLE 1

Aluminium alloy A of the invention and aluminium alloy B for comparison, compositions of which are indicated in Table 1, were molten and filtered, followed by scalping both surfaces thereof to obtain 400 mm×1000 mm×3500 mm ingots.

Each ingot was homogenized at a temperature of 530° C. for 12 hours and hot rolled to obtain a sheet having a thickness of 5 mm, followed by cold rolling to a thickness of 2 mm.

Thereafter, the sheet was punched to obtain a disc having an outer diameter of 130 mm and a center hole with a diameter of 40 mm, followed by annealing at a temperature of 360° C. for 4 hours. The mechanical properties of the disc are shown in Table 2.

The disc was cut on the surface thereof to obtain an aluminium alloy substrate for a magnetic disc with Rmax of 0.08 μm.

The thus obtained disc was treated by a number of steps including: degreasing with trichloroethane; etching with an alkali by immersing in 5% NaOH solution at 25° C., for 30 seconds; neutralizing by immersing in 30% $HNO_3$ at 25° C. for 10 seconds; washing with an acid by immersing in $HNO_3$:HF:$H_2O$=3:1:2 at 25° C. for 30 seconds; first immersion plating with zinc by immersing in a composition comprising 120 g/l of NaOH, 20 g/l of ZnO, 2 g/l of $FeCl_3.6H_2O$, 50 g/l of $KNaC_4H_4O_6.4H_2O$, and 1 g/l of $NaNO_3$ at 25° C. for 30 seconds; washing with an acid by immersing in 20% $HNO_3$ at 25° C. for 10 seconds; second immersion plating with zinc under the same conditions as in the first immersion plating; and plating with Ni—P by immersing in Blue Sumer, by Japan Kanigen Co. LTD., at 90° C. in thickness of 5 and 20 μm. Thereafter, the prime coating treatability, plate adhesion, degree of surface roughness after the plating, and degree of surface smoothness after polishing of the plated surface were checked. The results are shown in Table 3.

The prime coating treatability was determined as follows: the surface after the second immersion plating with zinc was observed and evaluated as "o" when the deposit was uniform, as "x" when grains of the deposit were irregular, and as "Δ" when the deposit was intermediate between "o" and "x".

The plate adhesion was evaluated as "o" when no separation of plating took place upon bending of the substrate by 90° and as "x" when partial separation occurred.

The surface smoothness was determined by subjecting the plated surface to mirror polishing using aluminum oxide powder and observing the polished surface. The depth of polishing was determined to be 2 μm and 50 points on the surface were observed through a microscope by 400× magnification and evaluated as "o" in which no pits with maximum diameters of 2 μm or larger were found, as "Δ" in which 1 to 4 pits were found, and as "x" in which five or more pits were found.

As will be seen from Table 2, the alloy A of the invention is not only equal in mechanical properties to the comparative alloy B, but also superior in the prime coating treatability and much better in the surface smoothness.

TABLE 1

| | | Si | Fe | Cu | Mn | Mg | Cr | Zn (wt %) | Ti | Al |
|---|---|---|---|---|---|---|---|---|---|---|
| A | (Invention) | 0.04 | 0.06 | 0.15 | 0.002 | 4.0 | 0.002 | 0.30 | 0.005 | balance |
| B | (Comparison) | 0.04 | 0.06 | 0.002 | 0.002 | 4.0 | 0.002 | 0.002 | 0.005 | balance |

TABLE 2

| | Tensile Strength (Kg/mm²) | Yield Strength (Kg/mm²) | Elongation (%) |
|---|---|---|---|
| A | 26.4 | 11.9 | 23.8 |
| B | 26.5 | 12.2 | 26.0 |

TABLE 3

| | Prime Coating Treatability | Plating Adhesion: Thickness of Plating 5 μm | Plating Adhesion: Thickness of Plating 20 μm | Roughness of Plated Surface Ra (μm): Thickness or Plating 5 μm | Roughness of Plated Surface Ra (μm): Thickness of Plating 20 μm | Surface Smoothness: Thickness of Plating 5 μm | Surface Smoothness: Thickness of Plating 20 μm |
|---|---|---|---|---|---|---|---|
| A | o | o | o | 0.021 | 0.012 | o | o |
| B | Δ | o | o | 0.197 | 0.078 | x | x |

EXAMPLE 2

Aluminium alloys C, D and E of the present invention and comparative alloys G, H and I, which had compositions indicated in Table 4, were worked in the same manner as in Example 1 to obtain aluminium alloy substrates for magnetic discs.

It will be noted that the alloy F of the present invention indicated in Table 4 was treated as follows: the alloy was cast into a 5 mm thick sheet by a continuous thin sheet casting method, heated at a temperature of 450° C. for 6 hours and cold rolled to a thickness of 2 mm, followed by repeating the procedure of Example 1 to obtain an aluminum alloy substrate for magnetic discs.

The mechanical properties of these substrates are indicated in Table 5.

Each substrate was subsequently plated in the same manner as in Example 1 to check the prime coating treatability, plate adhesion, degree of surface roughness of the plated metal, and surface smoothness.

As will be seen from Table 5 the alloys C, D, E and F of the invention are equal to or higher than the comparative alloys G, H and I with respect to mechanical properties. The results of Table 6 reveal that the alloys C, D, E and F of the invention are much superior in the prime coating treatability, degree of surface roughness and surface smoothness to the comparative alloys G, H and I.

TABLE 4

| | Chemical Compositions (wt %): Si | Fe | Cu | Mn | Mg | Cr | Zn | Ti | Al | |
|---|---|---|---|---|---|---|---|---|---|---|
| C | 0.01 | 0.02 | 0.25 | 0.002 | 4.0 | 0.08 | 0.50 | 0.001 | balance | Invention |
| D | 0.06 | 0.13 | 0.05 | 0.33 | 2.7 | 0.01 | 0.15 | 0.01 | balance | |
| E | 0.07 | 0.17 | 0.10 | 0.25 | 5.2 | 0.08 | 1.10 | 0.01 | balance | |
| F | 0.10 | 0.24 | 0.08 | 0.20 | 4.5 | 0.07 | 0.20 | 0.02 | balance | |
| G | 0.01 | 0.01 | 0.002 | 0.002 | 4.5 | 0.002 | 0.001 | 0.001 | balance | Comparison |
| H | 0.10 | 0.18 | 0.01 | 0.38 | 4.0 | 0.09 | 0.01 | 0.02 | balance | |
| I | 0.08 | 0.13 | 0.96 | 0.33 | 3.0 | 0.09 | 2.5 | 0.02 | balance | |

TABLE 5

| | Tensile Strength (Kg/mm²) | Yield Strength (Kg/mm²) | Elongation (%) |
|---|---|---|---|
| C | 26.3 | 11.6 | 22.2 |
| D | 20.3 | 10.1 | 26.3 |
| E | 27.7 | 13.2 | 25.1 |
| F | 27.3 | 12.9 | 26.5 |
| G | 25.4 | 10.5 | 21.5 |
| H | 26.9 | 12.4 | 27.9 |
| I | 19.1 | 9.6 | 26.2 |

TABLE 6

| | Prime Coating Treatability | Plating Adhesion: Thickness of Plating 5 μm | Plating Adhesion: Thickness of Plating 20 μm | Roughness of Plated Surface, Ra (μm): Thickness of Plating 5 μm | Roughness of Plated Surface, Ra (μm): Thickness of Plating 20 μm | Surface Smoothness: Thickness of Plating 5 μm | Surface Smoothness: Thickness of Plating 20 μm |
|---|---|---|---|---|---|---|---|
| C | o | o | o | 0.024 | 0.013 | o | o |
| D | o | o | o | 0.027 | 0.013 | o | o |
| E | o | o | o | 0.029 | 0.015 | o | o |
| F | o | o | o | 0.022 | 0.012 | o | o |
| G | x | x | x | 0.344 | 0.122 | x | x |
| H | o | o | o | 0.052 | 0.029 | x | o |
| I | o | o | o | 0.094 | 0.044 | x | Δ |

Figure 1B:
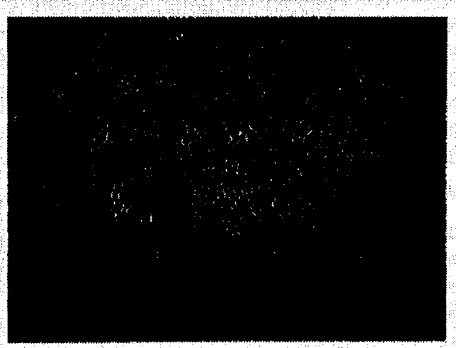
Figure 1A:
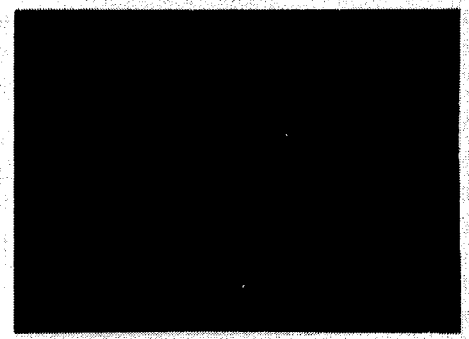

FIGS. 1(*a*) through 1(*c*) are secondary electron ray images of surfaces of the alloy A of the invention and the comparative alloys B and H after the second immersion plating with zinc. As will be seen, with the alloy of the invention, deposition of zinc is uniform and a number of pits caused by falling-off of the intermetallic compounds are small with good surface smoothness and uniformity.

Figure 2C:
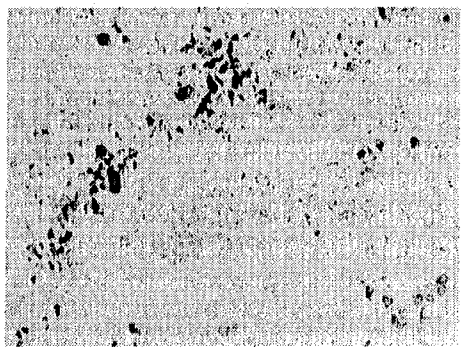
FIGS. 2(*a*), 2(*b*) and 2(*c*) are microphotographs showing an aluminium alloy sheet for magnetic discs having good platability and comparative sheets subjected to Ni-P plating.
Figure 2B:
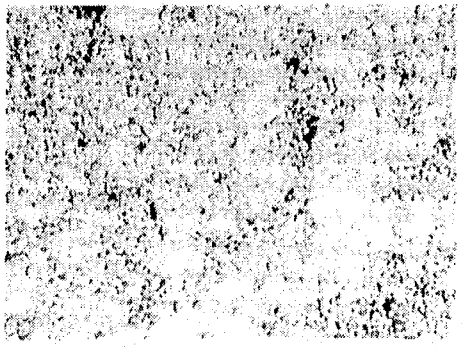
Figure 2A:
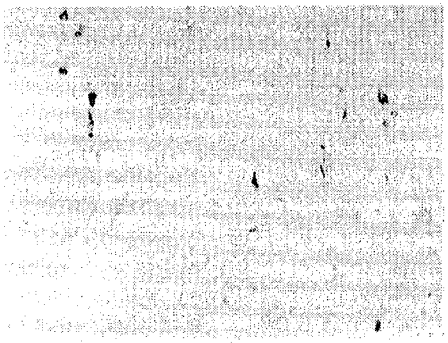

FIGS. 2(*a*) through 2(*c*) are microphotographs of surfaces of the alloy A of the invention and the comparative alloys B and H after being subjected to Ni—P plating (film thickness: 2 μm), revealing that the alloy of the invention involves only a very small number of plating defects (i.e. portions observed as black in FIG. 2).

As will be appreciated from the foregoing, the aluminium alloy sheets of the invention having good platability have good plating adhesion, a small degree of plated surface roughness, and good surface smoothness. The alloy sheets are suitable as substrates for magnetic discs, optical discs and optical-magnetic discs.

What is claimed is:

1. An aluminum alloy substrate for magnetic disc, which is produced by the process comprising:

homogenizing the aluminum alloy at temperatures over 400° C. in the form of ingot or continuously cast thin sheet coil, which alloy consists essentially of 2 to 6 wt. % of Mg, 0.1 to 0.5 wt. % of Zn, 0.15 to 0.40 wt. % of Cu, 0.01 to 0.30 wt. % of Fe, the balance Al and impurities;

optionally hot rolling the homogenized aluminum alloy;

cold rolling the homogenized or hot rolled aluminum alloy;

punching the aluminum alloy thus cold rolled to form a disc blank;

cutting, polishing or both the surface of the disc blank to obtain a substrate; and plating the substrate to form a non-magnetic metallic film having 5 to 20 μm in thickness on at least one surface thereof so as to obtain a smooth surface.

2. The aluminum alloy substrate according to claim 1, wherein Cu is contained in an amount of from 0.15 to 0.30 wt. %.

3. The aluminum alloy substrate according to claim 1 or 2, wherein the content of Fe is in the range of from 0.01 to 0.15 wt. %.

4. The aluminum alloy substrate according to claim 3, wherein the content of Fe is in the range of from 0.02 to 0.10 wt. %.

5. The aluminum alloy substrate according to claim 1 or 2, wherein the content of Fe is in the range of from 0.10 to 0.30 wt. %.

6. The aluminum alloy substrate according to claim 1, wherein the non-magnetic metallic film is Ni—P.

* * * * *